United States Patent [19]

Suter

[11] Patent Number: 4,593,893

[45] Date of Patent: Jun. 10, 1986

[54] METHOD AND APPARATUS FOR SEQUENTIALLY ADVANCING AND CUTTING FORMS FROM TWO CONTINUOUS FORM-WEBS

[76] Inventor: Walter Suter, Ringlikerstrasse 39, CH-8142 Uitikon, Switzerland

[21] Appl. No.: 717,986

[22] Filed: Mar. 29, 1985

[30] Foreign Application Priority Data

Mar. 30, 1984 [CH] Switzerland ..... 1634/84

[51] Int. Cl.[4] ..... B65H 41/00

[52] U.S. Cl. ..... 270/52.5; 101/2; 101/226

[58] Field of Search ..... 270/58, 52.5, 39; 101/2, 226; 226/9

[56] References Cited

U.S. PATENT DOCUMENTS

| | | | |
|---|---|---|---|
| 3,795,394 | 3/1974 | Walker | 270/39 X |
| 3,855,457 | 12/1974 | Amundson et al. | 270/52.5 X |
| 4,018,431 | 4/1977 | Schueler | 270/52.5 |
| 4,054,235 | 10/1977 | Witcher | 270/52.5 |
| 4,094,498 | 6/1978 | Schueler | 270/52.5 |
| 4,442,774 | 4/1984 | Pou et al. | 101/226 X |
| 4,527,468 | 7/1985 | Piotroski | 101/2 |
| 4,535,892 | 8/1985 | Roes et al. | 101/2 |

FOREIGN PATENT DOCUMENTS 2723573 11/1978 Fed. Rep. of Germany ..... 101/2

OTHER PUBLICATIONS

"Continuous Paper Forms Severator", IBM Tech. Discl. Bulletin, vol. 5, No. 4, Sep. 1962, pp. 15–16.

*Primary Examiner*—E. R. Eickholt

*Attorney, Agent, or Firm*—Spencer & Frank

[57] ABSTRACT

A method of sequentially advancing, cutting and sorting forms attached together serially in two single-path form-webs in which the forms carry a code to identify forms to be assembled together by sorting, comprises the following consecutive steps: introducing the two webs in a superposed state and with an at least partial lateral overlap to a cutting table such that a perforated margin on each web is situated along opposite external edges when viewing the two superposed webs together; engaging each web solely at the outer perforated margin by a tractor device on the cutting table and advancing each web on the cutting table by a perforated margin solely along one longitudinal web edge; transversely severing the forms from the web by a transverse cutter of the cutting table; and sorting and assembling the forms as a function of the code thereon.

13 Claims, 4 Drawing Figures

METHOD AND APPARATUS FOR SEQUENTIALLY ADVANCING AND CUTTING FORMS FROM TWO CONTINUOUS FORM-WEBS

BACKGROUND OF THE INVENTION

This invention relates to a method and an apparatus for sequentially advancing and cutting documents (forms) which are originally present in two single-path, continuous form-webs. Thus, the forms originate either from a dual-path, single web printout with equal or unequal number of associated forms (that is, forms which belong to one another) or from two single-path continuous form-webs.

Continuous form-webs having pairwise or non-pairwise, side-by-side arranged forms of the so-called "two-up in sequence" (two-up slalom print) type are known. For example, in a single form-web (which may consist of several superposed layers) the forms are arranged in two side-by-side situated, interconnected, endless series. Thus, viewing the web transversely, the forms are in pairs. The forms in the web constitute form groups. Forms within each group belong to one another and are to be assembled together after separation from the web. The number of forms within one group may vary widely, for example, from one to five. It follows that a form pair (that is, two side-by-side situated forms in the web) may or may not belong to the same form group and the same applies to any consecutive forms that is, two forms adjoining in the length direction of the web). The problem involved in such webs is to ensure that forms belonging to different groups are not brought (assembled) together and also, confidentiality of the contents is preserved.

Identical or at least similar problems are encountered in case of two single-path form-webs where the forms are of different length dimensions in one paper web as compared to the forms in the other paper web. This will be the case, for example, if one web contains lengthwise or transversely arranged A4-format forms of bank statements, while the other web contains, for example, money transfer orders. Then, each "group" may consist of several forms situated in the first web and a single form situated in the second web.

In automated processes of cutting, sorting and depositing and/or stuffing such forms, problems have been encountered in the stacking operation to ensure that in case of consecutive forms belonging to one another, the trailing form is positioned on top of the leading form in a compartment and in case of non-belonging consecutive forms the trailing form has a sufficient distance from the leading form or in case of non-uniform formats an association is possible to ensure that between consecutive forms there is sufficient time available to change the compartment and to direct the trailing form into another compartment.

For the above purpose, stacking devices known from the printing technology have been used which either lift and organize the forms by means of suction heads or the forms are transported on conveyor belts or immobilized by magnetically applied pressure. While the first-named system is too slow for data processing machines, with the second system, to be sure, the speed could be increased but the supports for the conveyor belts were exposed to blows and therefore a frequent replacement of these supports has been necessary.

In Swiss Patent Application No. 4083/81 it has been proposed to arrange a transfer table downstream of the edge cutting and transverse cutting table, in which a roller track with rollers oriented obliquely to the conveying direction is arranged and where the rollers are divided into groups which are driven with different rpm's and further, at least the upstream arranged roller group may be stopped. With this arrangement it was achieved that the downstream-situated form could be rapidly moved away and the upstream form could be retained if the two side-by-side printed forms belonged to a non-pairwise arrangement to thus avoid the necessity of providing an intermediate stacker.

SUMMARY OF THE INVENTION

It is an object of the invention to provide an improved method and apparatus of the above-outlined type with significant simplifications to reduce costs.

This object and others to become apparent as the specification progresses, are accomplished by the invention, according to which, briefly stated, the method of sequentially advancing, cutting and sorting forms attached together serially in two single-path form-webs in which the forms carry a code to identify forms to be assembled together by sorting, comprises the following consecutive steps: introducing the two webs in a superposed state and with an at least partial lateral overlap to a cutting table such that a perforated margin on each web is situated along opposite external edges when viewing the two superposed webs together; engaging each web solely at the outer perforated margin by a tractor device on the cutting table and advancing each web on the cutting table by a perforated margin solely along one longitudinal web edge; transversely severing the forms from the web by a transverse cutter of the cutting table; and sorting and assembling the forms as a function of the code thereon.

DESCRIPTION OF THE PREFERRED EMBODIMENT

Figure 1:
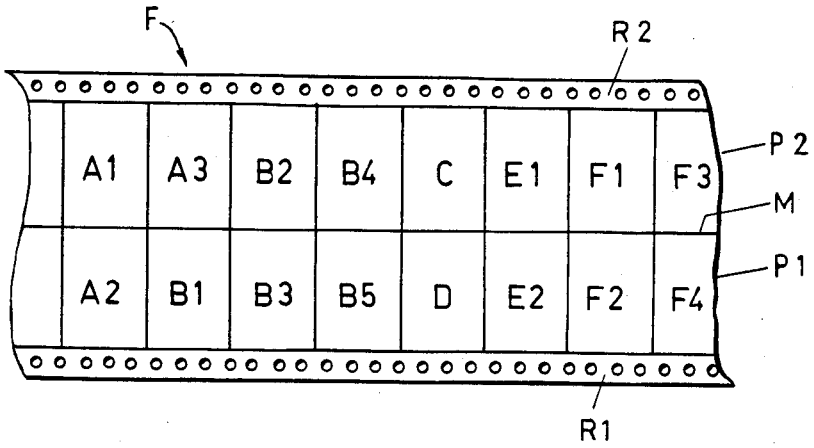
FIG. 1 is a schematic illustration of a continuous, dual-path form-web.

Turning to FIG. 1, there is shown a continuous form-web F of the type to be handled by the method and apparatus according to the invention. The form-web F has two interconnected form paths (partial webs) P1 and P2 and there are shown therein sixteen different forms A1–A3, B1–B5, C, D, E1, E2 and F1–F4. viewing the web F transversely to its length, that is, transversely to its direction of run, the forms are arranged pairwise. Further, the sixteen forms constitute six groups; the forms within each group are to be collected (assembled) together upon separation. The first group consists of forms A1, A2 and A3, the second group consists of forms B1–B5, the third group consists of form C, the fourth group consists of form D, the fifth group consists of forms E1 and E2, while the sixth group consists of forms F1–F4. It is thus seen that, for example, the juxtapositioned forms A3 and B1 forming one pair belong to different groups and thus care has to be taken that these forms, although they are in the same juxtaposed pair, are not assembled together.

Figure 2:
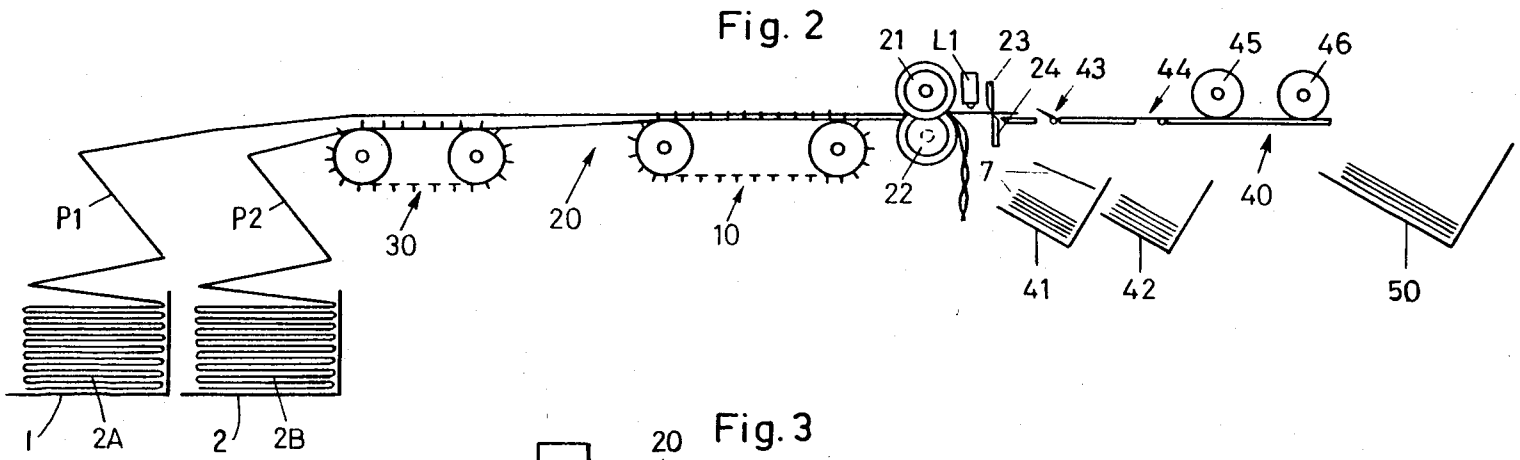
FIG. 2 is a schematic side elevational view of a preferred embodiment of the invention.
Figure 3:
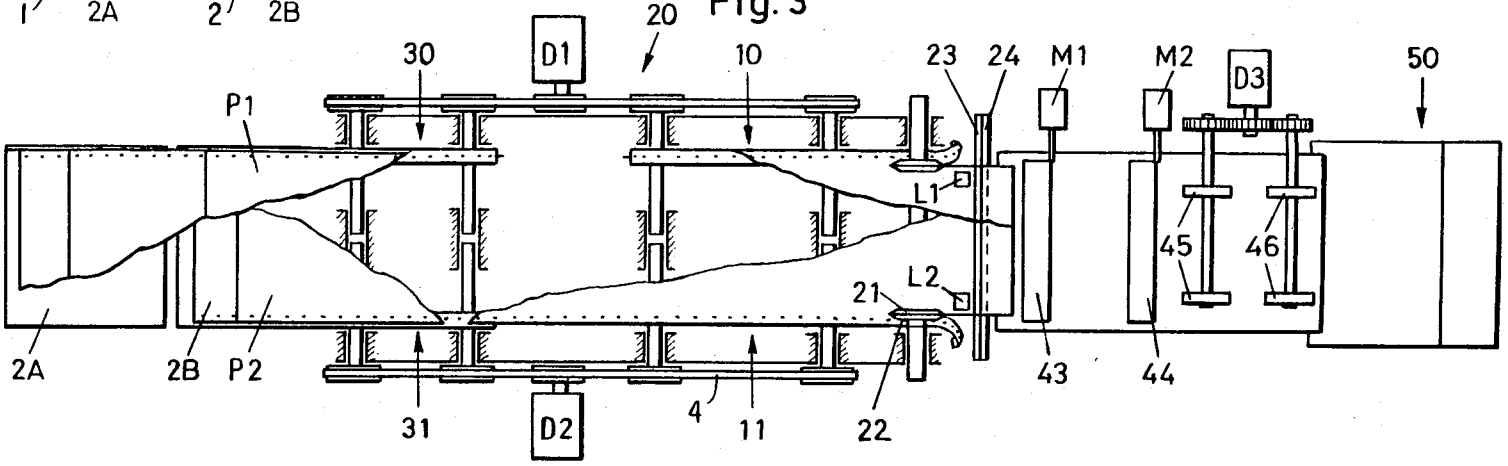
FIG. 3 is a top plan view of the apparatus shown in FIG. 2.

Turning now to FIGS. 2 and 3, in the process according to the invention, first the continuous form-web F is severed along the longitudinal center line M. In this manner, two endless paper stacks 2A and 2B are obtained which are stored in boxes 1 and 2. The edge cutting and transverse cutting table 20 has four sprocket belt tractors 10, 11, 30 and 31 for engaging into the perforated margin R1 of the longitudinally severed web half P1 and the perforated margin R2 of the web half P2.

The tractors 10 and 30 are driven pairwise by a drive D1 whereas the tractors 11 and 31 are driven pairwise by a drive D2. The drives D1, D2 may be separate motors which drive, by means of respective toothed belts 3 and 4, the associated pairs of tractors with one another in a synchronous manner. Instead of individual motors it is feasible to provide a single motor and electrically switchable clutches for driving the tractor pairs 10, 30 and 11, 31. Downstream of the tractors 10, 11 there is situated a longitudinal cutter 21, 22 and spaced downstream therefrom, a transverse cutter 23, 24.

The two partial form-webs P1, P2 are placed in a partial lateral overlap on the cutting table 20 in such a manner that the perforations R1, R2 are inserted in the left-hand and in the right-hand tractor pairs, respectively. The two partial form-webs P1, P2 are thus arranged parallel to one another and, after longitudinally severing the perforated margins R1, R2 by the cutter 21, 22 and transversely separating the forms by the transverse cutter 23, 24, they may be gathered in a simple manner by a known sorting and gathering machine 40 or may be deposited in sorting compartments 41, 42. The partial form-webs P1, P2 are admitted to the sorting compartments 41, 42 by magnetically, hydraulically or pneumatically operated separator gates 43, 44. In the described embodiment electromagnets M1, M2 are provided. The separator gate 43 is shown open and the separator gate 44 is shown closed, whereby a single form or document 7 falls into the sorting compartment 41.

The separator gates 43, 44 are adjoined by roller pairs 45 and 46 which are connected with a drive D3 which, similarly to the drives D1 and D2, may be a separate motor or a switchable clutch to ensure that documents belonging together are transported individually or in pairs to a compartment 50 dependent upon whether the documents are arranged pairwise or non-pairwise.

Instead of a compartment 50 a folding or stuffing station may be provided to thus ensure that the documents may be handled without manual interference, whereby secrecy is ensured to the greatest possible extent.

Figure 4:
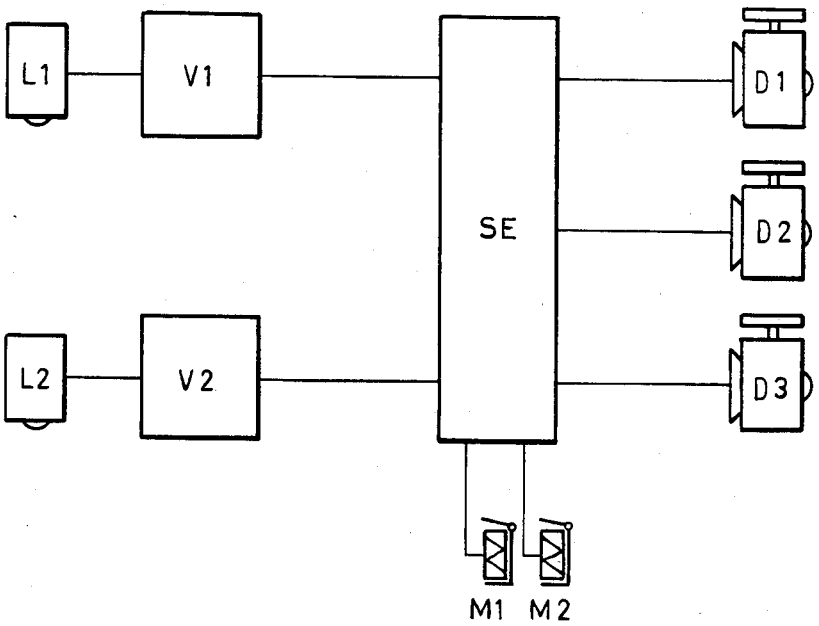
FIG. 4 is a block diagram of an electronic control arrangement incorporated in the preferred embodiment.

Turning now to FIG. 4, there is illustrated schematically a basic electronic circuitry for controlling the drives and the separators of the form-web handling machine. With two optical readers L1, L2 (FIGS. 2 and 3) which are situated between the longitudinal and transverse cutters 21, 22 and 23, 24, markings (code) such as dots provided by a printer on the edge of the forms are being read. For this purpose, electro-optical arrangements of known construction may be used which emit "light" and "dark" signals to be processed. After an amplification of the signals emitted by the optical readers L1 and L2 in separate amplifiers V1 and V2 the signals are applied to a control unit SE in which the moment and duration of the energization of the drives D1, D2 and D3 have been previously determined. Further, the control unit SE energizes and de-energizes the magnets M1, M2 for actuating the separator gates 43, 44.

With the above-discussed device, which differs from a longitudinal and transverse cutting table constituting an individual unit in that the tractors 10, 11, 30 and 31 are coupled pairwise at the left and at the right and are driven separately or in a coupled manner, all kinds of forms such as bills, accounting forms, etc. may be printed out in a combined manner independently from their orientation and may be appropriately gathered in sequence. By virtue of the relatively simple change effected in an otherwise known machine, devices which had to be used heretofore, such as two separate cutting machines or the provision of idle runs upon printing for changing the odd number printouts to even number (pairwise) printouts may be dispensed with. If, with conventional means an automatic operation without any manual interference was to be effected to ensure secrecy, expensive sequentially operating devices, two-path drives and devices for converting into single-path runs had to be provided.

In conventional machines advancing continuous form-webs, the transporting devices are coupled at the left and at the right as well as pairwise, to ensure a correct transportation. According to the invention, the transporting means on the left and the right are arranged behind one another and may be driven individually or in pairs to ensure that the partial form-webs can be properly transported although they have only a single perforated margin.

By controlling the separator gates 43 and 44 additional collectors may be formed in order to gather the forms of one path and advance forms of the other path. Expediently, the forms to be collected are advanced in a lower transport path and the individual forms of the other path are individually advanced in an upper, not illustrated transport path which could also be fed by means of a separator gate.

It will be understood that the above description of the present invention is susceptible to various modifications, changes and adaptations, and the same are intended to be comprehended within the meaning and range of equivalents of the appended claims.

What is claimed is:

1. A method of sequentially advancing, cutting and sorting forms attached together serially in two single-path form-webs in which the forms carry a code to identify forms to be assembled together by sorting, comprising the following consecutive steps:

(a) introducing the two webs in a superposed state and with an at least partial lateral overlap to a cutting table such that a perforated margin on each web is situated along opposite external edges when viewing the two superposed webs together;

(b) engaging each web solely at said perforated margin by tractor means on said cutting table and advancing each web on said cutting table by a perforated margin solely along one longitudinal web edge;

(c) transversely severing the forms from the web by a transverse cutter of the cutting table; and (d) sorting and assembling the forms as a function of the code thereon.

2. A method as defined in claim 1, further comprising the step of longitudinally severing a dual-path, single form-web for obtaining said two single-path form-webs.

3. A method as defined in claim 1, further comprising the step of severing said perforated margins with longitudinal cutters of the cutting table subsequent to step (b) and prior to step (c).

4. A method as defined in claim 1, further comprising the step of removing perforated margins from the two webs at inwardly oriented longitudinal edges thereof prior to step (a).

5. A method as defined in claim 1, wherein step (b) includes the step of advancing the two webs with identical speeds to the transverse cutter.

6. A method as defined in claim 1, wherein step (b) includes the step of advancing the two webs with different speeds to the transverse cutter.

7. A method as defined in claim 1, wherein the sorting and assembling step comprises the following steps:

(a) collecting the transversely separated forms originating from one of said webs in at least one intermediate stacker;

(b) advancing the forms from the intermediate stacker to a station together with a form originating from the other of said webs, without change of direction.

8. A method as defined in claim 7, wherein the forms originating from said other web are trailing relative to the forms originating from said one web.

9. A method as defined in claim 7, wherein the forms originating from said other web are leading relative to the forms originating from said one web.

10. An apparatus for sequentially advancing, cutting and sorting forms attached together serially in two single-path form-webs in which the forms carry a code to identify forms to be assembled together, comprising:

(a) a cutting table including longitudinal cutters for removing perforated margins from the webs and a transverse cutter for severing forms from the webs;

(b) two tractor means arranged on opposite sides of said cutting table for engaging perforated margins of the webs to advance the webs on the cutting table;

(c) drive means for driving the two tractor means independently from one another;

(d) sensor means for responding to the code on the forms; and (e) a control apparatus having inputs connected with said sensor means for receiving from said sensor means signals representing the code on the forms; said apparatus having outputs connected with said drive means for driving said tractor means as a function of said signals.

11. An apparatus as defined in claim 10, wherein said transverse cutter is spaced from said longitudinal cutter in a direction parallel to an advancing direction of the webs; further wherein said sensor means is situated between said transverse cutter and said longitudinal cutter.

12. An apparatus as defined in claim 10, further comprising a sorting and assembling device situated downstream of said cutting table as viewed in the direction of web advance, said sorting and assembling device including drives connected to outputs of said control apparatus for controlling said drives as a function of said signals.

13. An apparatus as defined in claim 10, wherein each said tractor means comprises one pair of tractors spaced from one another in a direction parallel to an advancing direction of the webs.

* * * * *